US008182283B2

(12) United States Patent
Chang

(10) Patent No.: US 8,182,283 B2
(45) Date of Patent: May 22, 2012

(54) BUILT-IN USB3.0 RECEPTACLE CONNECTOR

(76) Inventor: Nai-Chien Chang, Taipei County (TW)

( * ) Notice: Subject to any disclaimer, the term of this patent is extended or adjusted under 35 U.S.C. 154(b) by 1 day.

(21) Appl. No.: 13/006,515

(22) Filed: Jan. 14, 2011

(65) Prior Publication Data

US 2011/0237093 A1 Sep. 29, 2011

(30) Foreign Application Priority Data

Mar. 23, 2010 (TW) ..... 99205065 U

(51) Int. Cl.
*H01R 13/66* (2006.01)

(52) U.S. Cl. ..... 439/541.5; 439/55; 439/76.1; 439/660; 439/941

(58) Field of Classification Search ..... 439/55, 439/76.1, 541.5, 660, 676, 941
See application file for complete search history.

(56) References Cited

U.S. PATENT DOCUMENTS 7,927,145 B1 * 4/2011 Chang ..... 439/607.31
7,988,460 B1 * 8/2011 Chiu et al. ..... 439/76.1
2010/0155489 A1 * 6/2010 Chang ..... 235/486
2010/0159746 A1 * 6/2010 Wan et al. ..... 439/607.11
2010/0159747 A1 * 6/2010 Chang ..... 439/607.35
2010/0167588 A1 * 7/2010 Chang ..... 439/620.22
2011/0124237 A1 * 5/2011 Chung ..... 439/676
2011/0136384 A1 * 6/2011 Chang ..... 439/620.22
2011/0136393 A1 * 6/2011 Chang ..... 439/676
2011/0237093 A1 * 9/2011 Chang ..... 439/55

* cited by examiner

*Primary Examiner* — James Harvey
(74) *Attorney, Agent, or Firm* — Chun-Ming Shih; HDLS IPR Services

(57) ABSTRACT

A build-in USB 3.0 receptacle connector is disposed for a main board located within a computer, the build-in USB 3.0 receptacle includes an insulated housing, a plurality cavities, a plurality set of circuit boards, a plurality set of connective terminals and a plurality of conductive terminals. The cavities are recessed from a front-end surface of the insulated housing, the circuit boards disposed and suspended in the cavities and having a first surface, a second surface and multiple golden-fingers disposed on the front fringe of the first surface. Each set of the connective terminal is connected to the rear fringe of the second surface and electrically connected to the golden-fingers disposed on the first surface. The conductive terminals are disposed in the cavities, respectively, and each of the conductive terminals has a contact segment disposed on the front fringe of the first surface which is behind the golden-fingers. Therefore, the insulated housing has a plurality of stocking USB 3.0 sockets is used for inserting USB devices.

10 Claims, 4 Drawing Sheets

BUILT-IN USB3.0 RECEPTACLE CONNECTOR

BACKGROUND OF THE INVENTION

1. Field of the Invention

The present invention is related to connector, and in particularly to a receptacle connector of USB.

2. Description of Prior Art

A universal serial bus (USB) is a transmission interface which is promoted by Intel Corp. and Microsoft Corp. The USB is becoming the most popular transmission interface of computers because it supports with hot swapping, namely, plug-and-play. Moreover, the development of USB has included USB 1.0 (low-speed rate of 1.5 Mbps), USB1.1 (full-speed rate of 12 Mbps) AND USB 2.0 (high-speed rate of 480 Mbps).

Because electronic devices are constantly developed to increase transmission rate, the USB 2.0 protocol does not meet current transmission rate requirement of new electronic devices. Therefore, USB 3.0 protocol is established for providing higher transmission rate. A USB 3.0 connector is composed of USB 2.0 having four lines (one power line, one ground line and two data transmission lines) and two data-output lines, two data-input lines and a ground line to form nine lines transmission interface for bidirectional transmission data through the four new data transmission lines, thus the transmission rate of the USB 3.0 can achieve 5 Gbps.

It should be noted that the USB transmission interface are popularly used in various external electronic devices such as portable optical disk drivers, portable hard drivers and portable solid state disk (SSD) due to the advantage of plug-and-play and the increasing transmission rate. Moreover, the transmission rate of USB 3.0 may be the same as the serial advanced technology attachment (SATA) with maximum transmission rate of 1.5 Gbps, external serial advanced technology attachment (eSATA) with maximum transmission rate of 3 Gbps and Firewire (IEEE1394) with maximum transmission rate of 3.2 Gbps. Therefore, USB transmission interface which is originally used for portable devices has been applied into a computer as a connector However, using the presently sold USB 3.0 receptacle connectors as USB receptacle connectors disposed within the computer results in high manufacturing cost and occupies more disposed-space of the computer's main board. What is needed, therefore, is to provide an easy way to achieve highest manipulation.

SUMMARY OF THE INVENTION

In order to solve the above-mentioned problem, a build-in USB 3.0 receptacle connector is disclosed for inserting USB devices and having advantages of reducing operation costs and disposing-space of a main board of a computer.

Therefore, the build-in USB 3.0 receptacle connector of the present invention includes an insulated housing, a plurality of circuit boards and a plurality set of connective terminals and a plurality set of conductive terminals. The insulated housing has a plurality of cavities recessed from a front end of the insulated housing. The circuit boards are disposed and suspended in the cavities, respectively, and having a first surface, a second surface and a multiple golden-fingers disposed on a front fringe of the first surface. Each set of the connective terminals is connected to a rear fringe of the second surface and electrically connected to the golden-fingers. The conductive terminals are respectively disposed in the cavities and having a contact segment disposed on a front fringe of the first surface which is behind the golden-fingers.

The build-in USB 3.0 receptacle connector according to the present invention has following advantages. When the build-in USB 3.0 receptacle connector is used within a computer, users do not concern about external interference, therefore, the build-in USB 3.0 receptacle connector does not need metallic shield by a metal shell thus the manufacturing cost can be reduced. Moreover, the stocked USB 3.0 socket may provide multiple USB devices inserting into the USB 3.0 socket and occupy low disposing-space of the main board of the computer.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

In cooperation with attached drawings, the technical contents and detailed description of the present invention are described thereinafter to a preferable embodiment, being not used to limit its executing scope.

Figure 1:
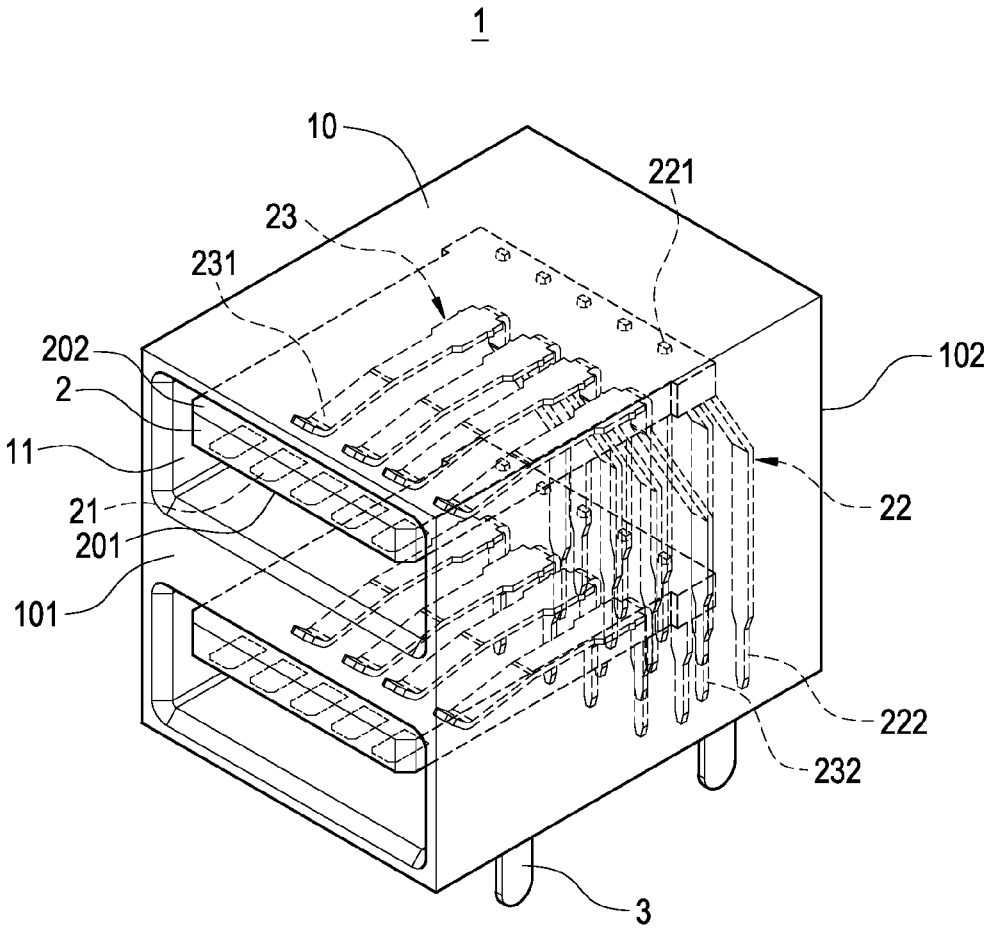
FIG. 1 is a perspective view of a receptacle connector according to a first embodiment of the present invention.
Figure 2:
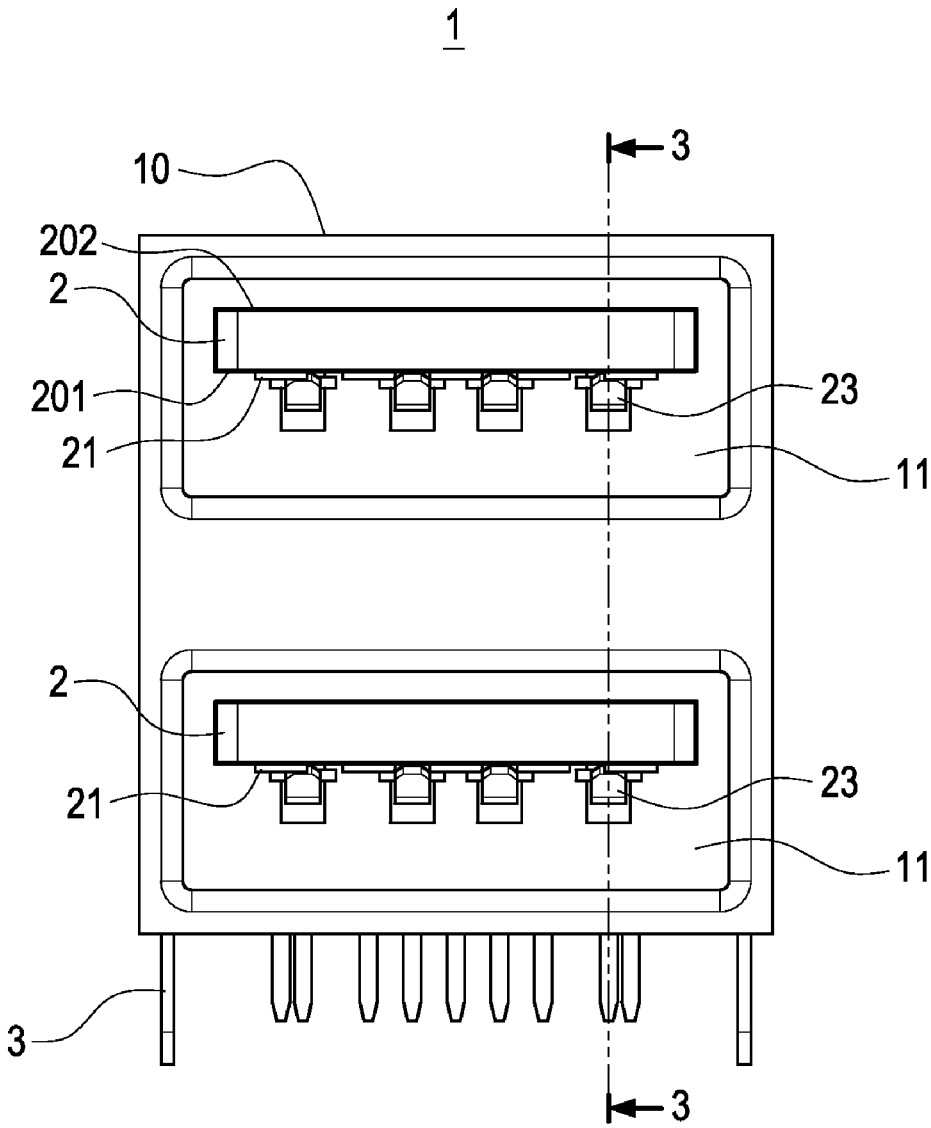
FIG. 2 is a front view of the build-in USB 3.0 receptacle connector.

Referenced is made to FIG. 1, which is a perspective view of a build-in USB 3.0 receptacle connector according to a first embodiment of the present invention. The build-in USB 3.0 receptacle connector 1 (referred to as connector 1 below) includes an insulated housing 10, a plurality of circuit boards 2, a plurality set of connective terminals 22 and a plurality set of conductive terminals 23. The insulated housing 10 has a front surface 101, a rear surface 102 and a plurality of cavities 11 inwardly-recessed from the front surface 101. In a preferring embodiment, the cavities 11 are formed in stacked fashion, the direction of which is perpendicular to the frond surface. In more particularly, one cavity 11, one circuit board 2, one set of the connective terminal 22 and one set of the conductive terminal 23 constitute a USB 3.0 socket. Referenced is made to FIG. 2, which is a front view of the build-in USB 3.0 receptacle connector according to the first embodiment of the present invention. The build-in USB 3.0 receptacle connector 1 of the embodiment provides two cavities 11 for example. The connector 1 may be capable of inserting two USB devices having USB 2.0 transmission interface or USB 3.0 transmission interface into the cavities 11.

The circuit board 2 is disposed and suspended in the cavity 11. The circuit board 2 having a first surface 201 and a second surface 202 opposite to the first surface 201. The first surface 201 has a plurality of golden-fingers 21 deposed on the first fringe, where the first fringe is near the front surface of the first surface of the insulated housing 10. In more particularly, the numbers of the golden-fingers disposed on the circuit are five.

The numbers of one set of the connective terminals 22 are five, and each of the connective terminals 22 has a connective segment 221. The connective segments 221 are electrically connected to the rear fringe of the second surface 202 which is far away from the front fringe of the circuit board 2 and the connective segments 221 are electrically connected to the golden-fingers 21 disposed on the first surface 201.

The numbers of one set of the conductive terminal located in the cavities 11 are four. A contact segment 231 is formed on each of the conductive terminals 23 which is behind the golden-fingers 21. In more particularly, the contact segment 231 is located below the first surface 201 but not attached to the first surface 201, thus the contact segment 231 and the golden-fingers 21 are disposed in different levels.

Figure 3:
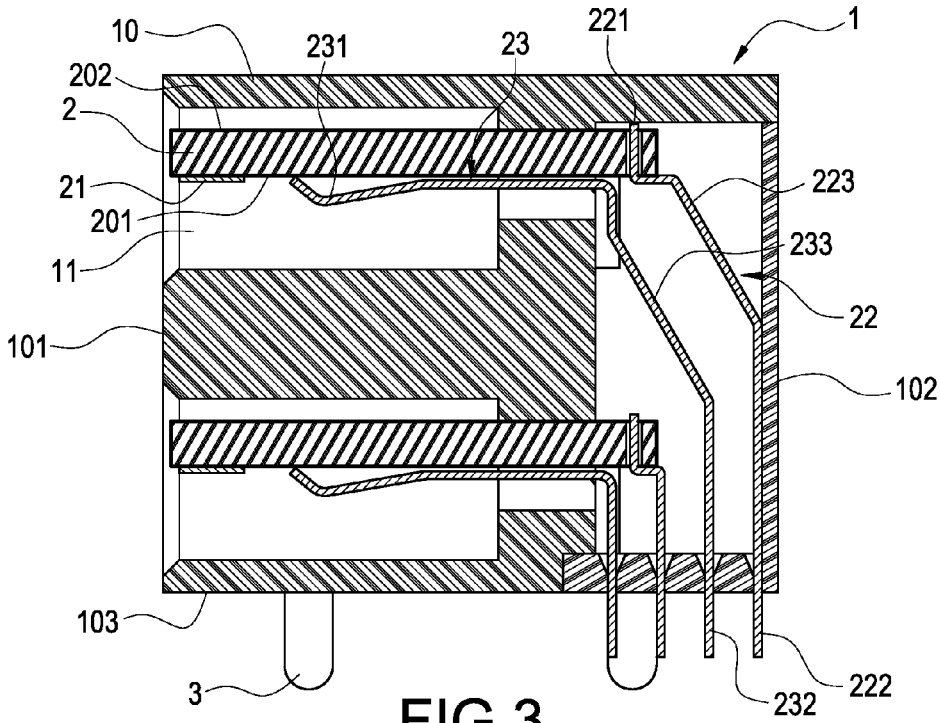
FIG. 3 is a section view of the build-in USB 3.0 receptacle connector.
Figure 4:
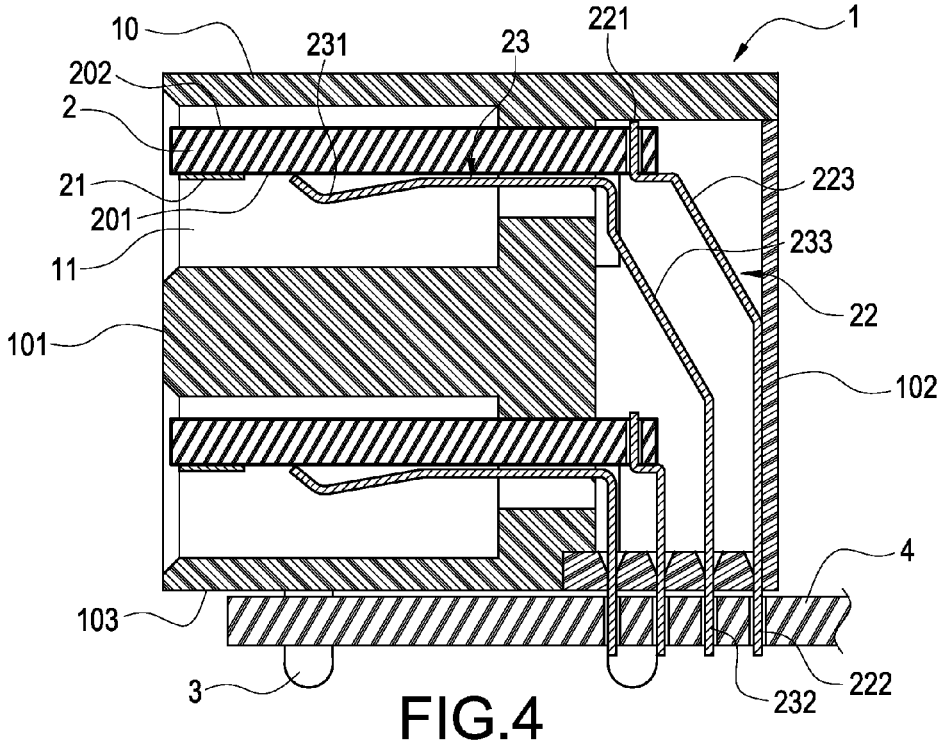
FIG. 4 is a another section view of the build-in USB 3.0 receptacle connector.

Referenced is made to FIG. 3 and FIG. 4, which are section views of the build-in USB 3.0 receptacle connector according to a first embodiment of the present invention. A first soldering segment 222 is formed on an end which is far away from the connective segment 221 of each of the connective terminals 22 and a first inclined segment 223 is formed between the connective segment 221 and the first soldering segment 222. The first soldering segments 222 extend obliquely downward from the first inclined segment 223 and protrude out of a bottom surface 103 of the insulated housing 10.

A second soldering segment 232 is formed on an end which is far away from the contact segment 231 of each of the conductive terminal 23 and a second inclined segment 233 is formed between the contact segment 231 and the second soldering segment 232. The second soldering segments 232 extend obliquely downward from the inclined segment 233 and protrude out of the bottom surface 103 of the insulated housing 10.

A plurality of fixed parts 3 are protruded downward from both side of the bottom surface 103 of the insulated housing 10 for fastening the connector 1 on a main board 4 disposed in a computer (not shown). The soldering segment 222, 232 protrude out of the bottom surface 103 of the insulated housing 10 and parallel to the fixed parts 3, thus the soldering segment 222,232 can be soldered on the main board 4 to electrically connect the connector 1 to the main board 4.

In a preferring embodiment, the connective terminals 22 and the conductive terminals 23 are oblique in 90 degree, thus the soldering segment 222, 232 may be soldered perpendicularly on the main board 4, the fixed parts 3 are also perpendicular to the main board 4 and the opening-direction of the cavities 11 are horizontally forward that the USB devices may be inserted horizontally into the cavity 11 of the connector 1 but is not limited to.

Figure 5:
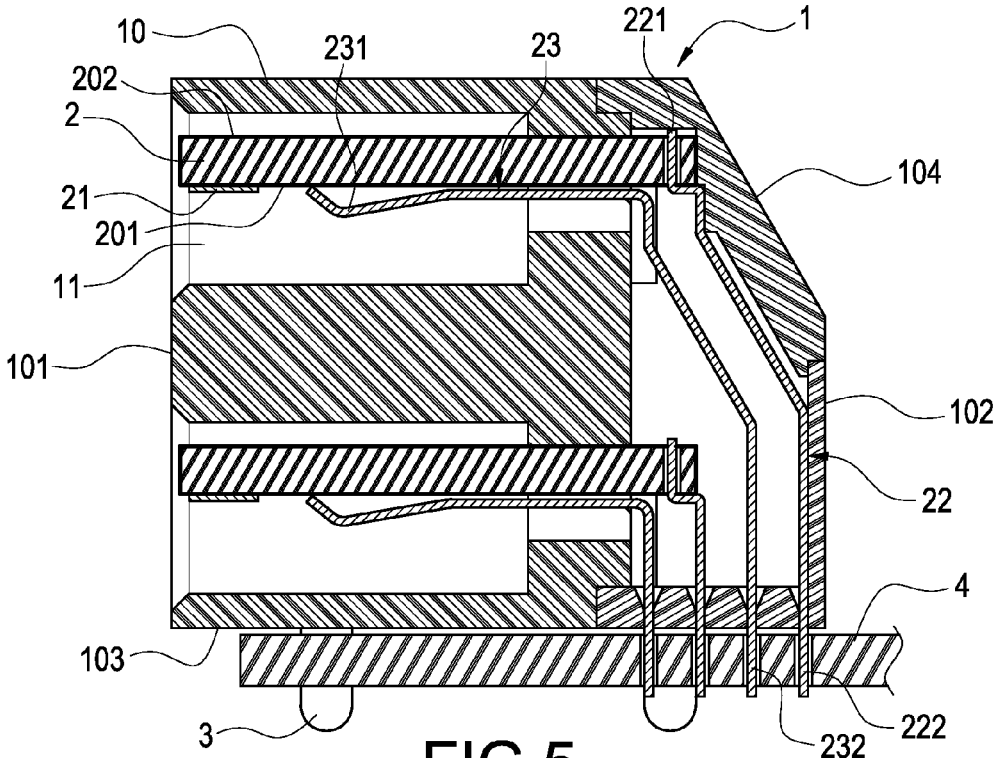
FIG. 5 is a section view of the build-in USB 3.0 receptacle connector according to a second embodiment.
Figure 6:
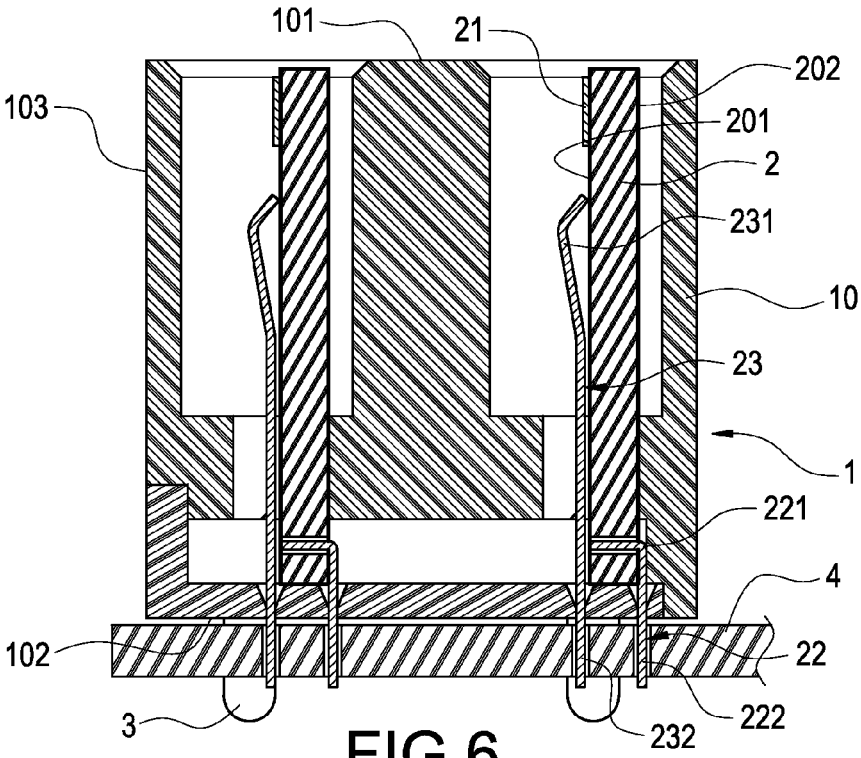
FIG. 6 is a section view of the build-in USB 3.0 receptacle connector according to a third embodiment.

Referenced is made to FIG. 5, which is a section view of the build-in USB 3.0 receptacle connector according to a second embodiment of the present invention. In the embodiment, the rear surface 102 of the insulated housing 10 has an inclined part 104. The inclined part 104 has advantage of decreasing disposing-volume of the insulated housing 10 to save the disposing-space when the insulated housing is disposed on the main board 4. Referenced is made to FIG. 6, which is a section view of the build-in USB 3.0 receptacle connector according to a third embodiment of the present invention. In the embodiment, the connective terminals 22 and the conductive terminals 23 are straight and have no inclined segment 223, 233. The soldering segments 222, 232 extend straightly from the connective segments 221 and the contact segments 231 protrude out of the rear surface 102 of the insulated housing 10. The fixed parts 3 are protruded backward from the rear surface 102 of the insulated housing 10 and parallel to the soldering segments 222, 232. The USB devices may be inserted perpendicularly into the cavities 11 of the connector 1 when the soldering segment 222, 232 are perpendicularly soldered on the main board 4 and the fixed parts 3 are perpendicularly fastened on the main board 4.

The connector 1 according to the present invention is used within computers and has advantage that users do not concern about external interference such as electromagnetic interference, therefore, the connector 1 does not need metallic shield by a metal shell covered over the insulated housing 10 and manufacturing cost can be reduced. Moreover, the stocking cavities 11 inwardly-recessed from the front surface 101 of the insulated housing 10 may provide multiple USB devices inserting into the USB 3.0 socket and occupy low disposing-space of the main board 4 of the computer.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A build-in USB 3.0 receptacle connector soldered on a main board disposed in a computer and the build-in USB 3.0 receptacle connector used for inserting USB devices therein, the build-in USB 3.0 receptacle connector comprising:

an insulated housing having a front surface, a rear surface and a plurality of cavities recessed from the front surface;

a plurality of circuit boards disposed and suspended in the cavities and having a first surface, a second surface opposite to the first surface, and multiple golden-fingers disposed on a front fringe, the front fringe being near a front surface of the first surface;

a plurality set of connective terminals disposed respectively in the cavities and corresponded to the circuit boards, each of the connective terminals having a connective segment connected to a rear fringe, the rear fringe being far away from the front fringe and on the second surface and electrically connected to the golden-fingers formed on the first surface; and a plurality set of conductive terminals disposed respectively in the cavities, each of conductive terminal having a contact segment disposed on the front fringe of the first surface behind the golden-fingers.

2. The build-in USB 3.0 receptacle connector in claim 1, wherein each of the cavities and the golden-fingers formed on one circuit board collectively constitute a USB 2.0 transmission interface.

3. The build-in USB 3.0 receptacle connector in claim 1, wherein each of the cavities, the golden-fingers formed on one circuit board, one set of the connective terminal and one set of the conductive terminal collectively constitute a USB 3.0 transmission interface.

4. The build-in USB 3.0 receptacle connector in claim 3, wherein the insulated housing has a bottom surface and a plurality of fixed parts are protruded from both side of the bottom surface for fastening the insulated housing to the main board.

5. The build-in USB 3.0 receptacle connector in claim 4, wherein a first soldering segment is formed on an end far away from the connective segment of the connective terminal, and a second soldering segment is formed on an end far away from the contact segment of the conductive terminal.

6. The build-in USB 3.0 receptacle connector in claim 5, wherein a first inclined segment is formed between the connective segment and the first soldering segment and a second inclined segment is formed between the contact segment and the second soldering segment, the first soldering segment and the second soldering segment extend obliquely downward from the first inclined segment and the second inclined segment, respectively, and protrude out of the bottom surface of the insulated housing and parallel to the fixed parts to be soldered on the main board.

7. The build-in USB 3.0 receptacle connector in claim 3, wherein a plurality of fixed parts are protruded backward from the rear surface of the insulated housing to fasten the insulated housing up to the main board.

8. The build-in USB 3.0 receptacle connector in claim 7, wherein a first soldering segment is formed on an end which is far away from the connective segment of the connective terminal and a second soldering segment is formed on an end which is far away from the contact segment of the conductive terminal, the first soldering segment and the second soldering segment extend straightly backward from the connective segment and the contact segment, respectively, and protrude out of the rear-end surface of the insulated housing and parallel to fixed parts to be soldered on the main board.

9. The build-in USB 3.0 receptacle connector in claim 3, wherein an incline part is formed on the rear surface of the insulated housing.

10. The build-in USB 3.0 receptacle connector in claim 3, wherein the numbers of the golden-fingers disposed on the circuit broad are five, the number of one set of the connective terminal are five and the number of one set of the conductive terminal are five.

* * * * *